United States Patent [19]

Lindblad

[11] Patent Number: 4,754,530

[45] Date of Patent: Jul. 5, 1988

[54] STRAP TENSIONING DEVICE

[76] Inventor: Lennart Lindblad, Hedåsgaten 16, S-447 00 Vårgårda, Sweden

[21] Appl. No.: 847,172

[22] PCT Filed: Jun. 19, 1985

[86] PCT No.: PCT/SE85/00258

§ 371 Date: Feb. 21, 1986

§ 102(e) Date: Feb. 21, 1986

[87] PCT Pub. No.: WO86/00200

PCT Pub. Date: Jan. 16, 1986

[30] Foreign Application Priority Data

Jun. 21, 1984 [SE] Sweden ..... 8403361

[51] Int. Cl.[4] ..... A44B 11/06

[52] U.S. Cl. ..... 24/169; 24/198; 24/200; 24/487

[58] Field of Search ..... 24/169, 196, 32, 35–36, 24/68 SB, 68 F, 19, 71 R, 71.3, 176, 198, 200, 487, 489, 559, 570, 532, 562

[56] References Cited

U.S. PATENT DOCUMENTS

| | | | |
|---|---|---|---|
| 323,084 | 7/1885 | Stratton | 24/198 |
| 1,148,972 | 8/1915 | Kops | 24/198 |
| 1,452,854 | 4/1923 | Taylor et al. | 24/200 X |
| 2,007,436 | 7/1935 | Troendly et al. | 24/198 X |
| 2,487,251 | 11/1949 | Lewis et al. | 24/198 X |
| 2,727,289 | 12/1955 | White et al. | 24/200 |
| 3,096,553 | 7/1963 | Gould | 24/487 |
| 3,127,656 | 4/1964 | Schwabe et al. | 24/487 |
| 3,249,978 | 5/1966 | Shears | 24/559 X |

FOREIGN PATENT DOCUMENTS

| | | | |
|---|---|---|---|
| 1225806 | 7/1960 | France | 24/169 |
| 1555221 | 1/1969 | France | 24/200 |
| 347685 | 4/1931 | United Kingdom | 24/200 |

*Primary Examiner*—Peter A. Aschenbrenner
*Assistant Examiner*—Laurie K. Cranmer

[57] ABSTRACT

A strap tensioning device includes a spring-loaded clamping element which presses a strap extending through the tensioning device against a holding bar using lever action. The device is composed of a minimum number of parts and is made from a monolithic plate of sprung material with cut-outs positioned so that both the holding bar and the clamping element and their mutual connecting parts are formed in one continuous piece from the plate which also forms the framework of the tensioning device. When the clamping element is pressed out of the plane of the frame, the clamping element rotates about a fulcrum and the pinching effect of the device is released so the strap can be released.

5 Claims, 3 Drawing Sheets

STRAP TENSIONING DEVICE

The present invention relates to a strap tensioning device of the kind with a spring-loaded clamping element which in its effective state presses a strap running through the tensioning device against a holding bar, with a friction effect.

It has been a constant aim in the development of tensioning devices of the above-mentioned kind to simplify them as far as possible in order to reduce material and other manufacturing costs as much as possible and thus also to lower the selling price. Hitherto, these tensioning devices have had a relatively complicated construction, consistently displaying a plurality of parts which have to be connected together during assembly.

The main object of the invention is to make significant progress towards the attainment of this goal, and to provide a tensioning device wherein the number of parts incorporated in the tensioning device is required to the absolute minimum.

This object is achieved with a tensioning device of the above-mentioned kind constructed according to the invention, which is essentially characterised in that it in constructed from a plate made of sprung material with cut-outs positioned so that both the holding bar and the clamping element and their mutual connecting parts are formed in one continuous piece from the plate which also forms the framework of the tensioning device, and wherein the clamping element is formed by a tongue cut and bent out of the plate and able to co-act with an abutment element which is able to rest against the planar face of the tongue and is stamped and bent out of the plate to form a pivot point for the tongue, the clamping element being so arranged that when a pinching effect is applied it rocks across the said abutment element and is forced to move away from the holding bar against the said spring effect, thereby releasing the strap.

With this construction the number of parts has been reduced to one single part, which is certainly absolutely the lowest number of parts which can be attained.

Figure 1:
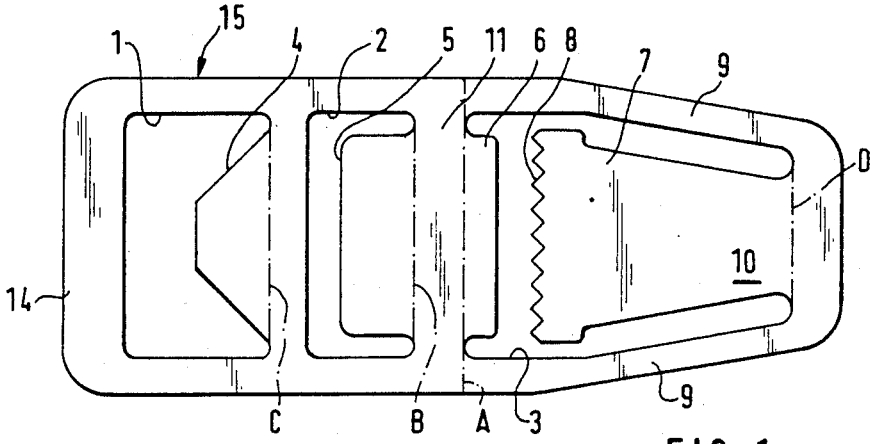
Figure 2:
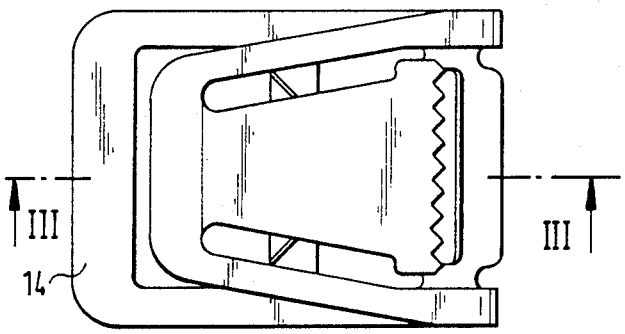
Figure 3:
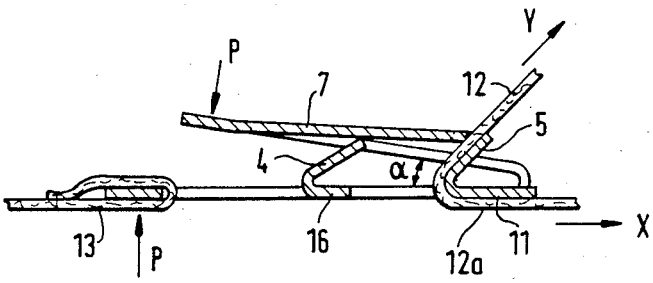
Figure 4:
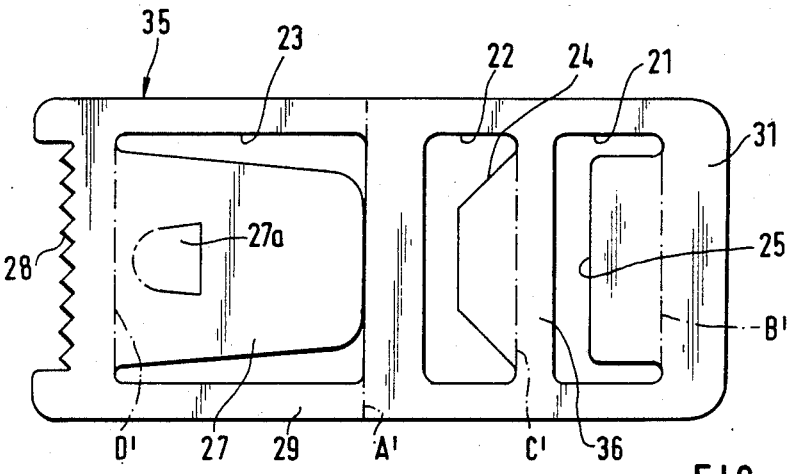
Figure 5:
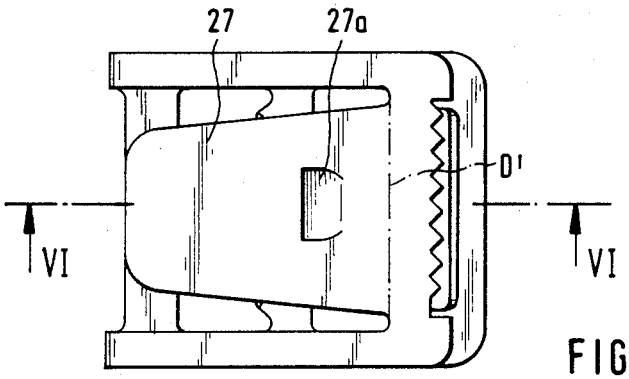
Figure 6:
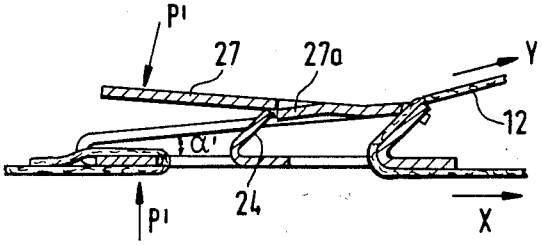
Figure 7:
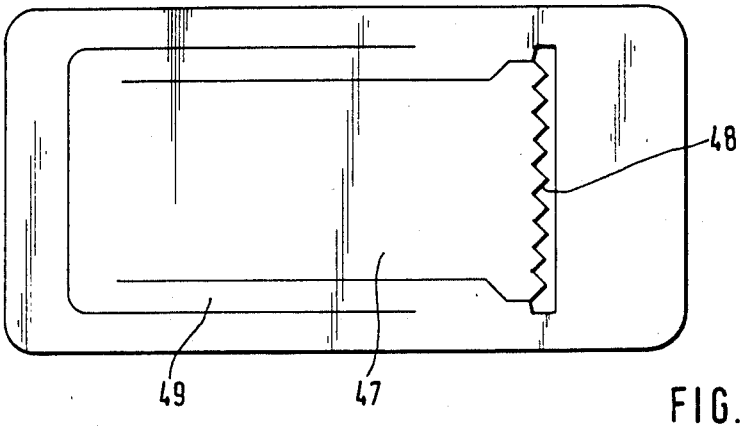
Figure 9:
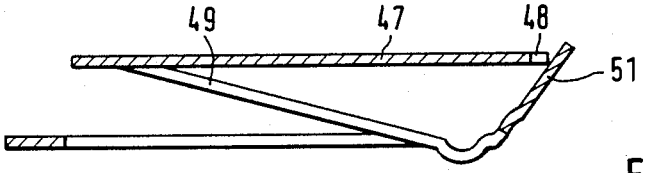
Figure 8:
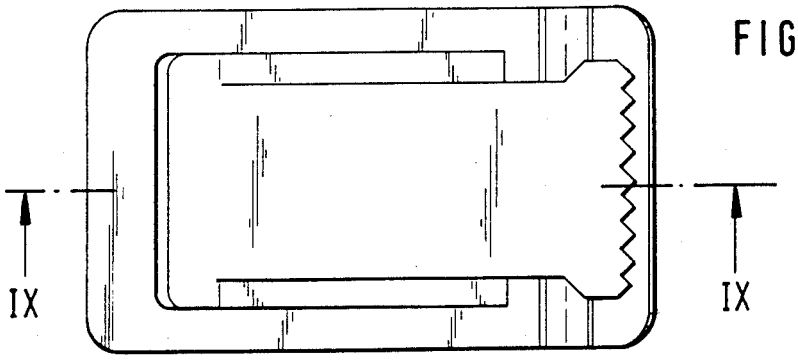

Some embodiment examples of the invention are described in the following with reference to the accompanying drawings, on which FIG. 1 is a view of a blank for a first embodiment example of a strap tensioning device according to the invention, FIG. 2 is a view of a finished tensioning device according to the same embodiment example shown in FIG. 1, FIG. 3 is a section along the line III—III through the tensioning device shown in FIG. 2, with a strap inserted and locked therein, FIG. 4 is a blank corresponding to that shown in FIG. 1 for a different embodiment according to the invention, FIG. 5 is a view corresponding to FIG. 2, showing the tensioning device according to the latter version, FIG. 6 is a section along the line VI—VI through the tensioning device shown in FIG. 5, FIG. 7 is a view corresponding to FIGS. 1 and 4 of a blank for a tensioning device according to a third embodiment version, FIG. 8 is a view corresponding to FIGS. 2 and 5 showing the last-named tensioning device, and FIG. 9 is a section along the line IX—IX in FIG. 8 through the tensioning device shown in FIG. 8.

The blank shown in FIG. 1 for a tensioning device according to a first embodiment example consists of a plate, preferably made of a bend-resistant and sprung plate, especially steel plate. Naturally, it is also within the scope of the invention to chose another material, such as a plastic, for example, although steel plate has until now been found to be the most suitable material. In the blank there are three cut-outs 1, 2 and 3 respectively. The cut-out 1, which has a substantially rectangular shape, is formed with a flap 4 on one side. The cut-out 2 is also substantially rectangular and has a second flap 5 on one of its sides, while a third flap 6 extends out from that side of the cut-out 3 which is nearest to the cut-out 2. 7 is the designation of a tongue which is attached to the remaining material, i.e. with the base of the tongue attached to the side of the cut-out 3 which is opposite the edge with the flap 6. The free terminal edge of the tongue 7 has serrations 8. 9 is the designation of the sections of material bridging over between the base part 10 of the tongue and the remainder of the plate. In the final bent state shown in FIGS. 2 and 3 the plate is bent along the line A to form substantially a V-shape with the acute angle of the V marked with $\alpha$ in FIG. 3. Furthermore, the flap 4 is bent up towards the lower planar face of the tongue 7 and is able to rest against this face. Furthermore, the flap 5 is bent up in front of the engaging serrations on the tongue, the flap 5 and the crossbar 11 with which it is integral being adapted to the serrations 8 and the angle $\alpha$ so that, due to the springing capacity of the material from which the tongue and the material bridging sections 9 are made, the serrations 8 are urged to clamp fast a strap 12 introduced through the tensioning device. 13 is the designation of a strap end which is laid in a loop round a crossbar 14 and which may possibly be part of the same strap as that indicated by the numeral 12. The plate shown and designated 15 as a whole thus forms the entire tensioning device, which functions as follows:

Due to the springing capacity of the material from which the tongue 7 and the bridging sections 9 are made the tongue is urged to press against the strap 12 via its serrated edge 8, and to press the strap against the holding bar 5, 11. When, due to a pinching effect, the tensioning device is pinched together in the direction of the arrows P then, due partly to the bending of the bridging sections 9 and partly to the seesaw movement of the tongue over the rocking nose formed by the flap 4, the serrated edge 8 of the tongue is forcibly lifted up away from the holding bar 5, 11 and thus releases the strap so that it can be pulled out of the tensioning device in the direction of the arrow X in FIG. 3. The strap 12 can be tensioned by pulling it in the direction of the arrow Y since the tongue automatically allows this movement, but as soon as the traction in the direction Y ceases and the pull on the active strap section 12*a* predominates the strap is effectively clamped fast. Like other tensioning devices of this kind, the tensioning device thus forms an automatically acting one-way lock. The material bridging sections 9 are relatively weak in this embodiment and can therefore easily be bowed when the tensioning device is being released from the strap. They also act as elements for absorbing the traction force when the strap is stretched taut. The tongue 7 is relatively broad which is appropriate since it takes the pressing force from the strap which strives to snap it. With the loads which occur in the application involved no strength problems arise when the bridging sections 9 alone absorb the traction force.

The tensioning device shown in FIGS. 4 to 6 has three cut-outs 21, 22 and 23, like the previous tensioning device. In the cut-out 21 there is a flap 25 which is integral with the crossbar 31, which has substantially the same function in co-action with the clamping element as the holding bar 5, 11 in the previous example. The crossbar to which the tongue 24 is attached is designated with the numeral 36 and has the same function as the crossbar 16 with the tongue 4 in the previous example. The tensioning device according to this second version is designated 35 as a whole and the initially flat planar blank shown in FIG. 4 is bent round the line A' to form an acute angle $\alpha'$ as shown in FIG. 6. In this embodiment the serrated terminal edge 28 is formed by one arm of the clamping part of the clamping device, while the base of the tongue 27 is connected to this effective part of the strap clamping element. As can be seen in FIG. 6, the tongue 27 is bent somewhat upwards around a bending line D' situated at its base, as in the previous example. Again in this example, the lower planar face of the tongue can rest against the upwardly protecting nose formed by the flap 24. Since, when the strap is pulled in the direction of the arrow X a pressing force acts on the tongue which strives to snap it, the tongue has been provided with a downwardly pressed flap 7*a* which rests against the top of the nose 24 and thus prevents the tongue from moving to the left in FIG. 6 with its engaging part. In this embodiment example the tensioning device is released by pinching in the direction of the arrows P' which causes a rocking effect over the nose 24 and thus causes the serrated engaging edge 28 to be lifted up from the strap 12. Apart from the aforegoing, the parts of this tensioning device which have a similar function to that of the parts in the previous tensioning device have been given similar reference designations, with the difference that the tens digit has been changed or, in the case of alphabetical designations, provided with a suffixed apostrophe.

The tensioning device shown in FIGS. 7–9 does not consist of a double-bent plate, but like the tensioning device according to the first embodiment example the tongue-shaped clamping element 47 presses via its serrated edge 48 the strap 12 against a holding bar 51. The tongue 47 is attached by its base to the frame part of the tensioning device via material bridging sections 49 which are cut out from the initial planar blank entirely surrounded by the material of the frame of the tensioning device. In this embodiment example, as in the first embodiment example, the tongue takes the pressure strain and the bridging sections 49 by which the tongue is attached to the remainder of the tensioning device take the traction force.

The invention is not limited to the embodiments which are described above and shown on the drawings purely by way of example, but the details thereof may be modified within the framework of the following Patent Claims without exceeding the scope of the invention.

I claim:

1. A strap tensioning device comprising:

a resilient monolithic plate which includes first, second and third sections, and a plurality of cutouts;

a tongue clamping element resiliently attached at a first end thereof to said plate and extending into a cutout in said first section and having a free end thereon;

a holding bar element attached at one end thereof to said plate and extending into another cutout and having a second end free;

a lever flap element attached at a base end thereof to said plate and extending into a cutout in said third section and having a free end;

said resilient monolithic plate being bent near the middle thereof to position said first section over said third section;

said holding bar element being bent to extend through said first cutout to be adjacent to said tongue clamping element free end with the resiliency of said plate biasing said tongue clamping element free end toward said holding bar element;

said lever flap element being bent so said lever flap element free end contacts said tongue clamping element between said tongue clamping element first end and said tongue clamping element free end to form a fulcrum of a lever with said tongue clamping element rotating about said fulcrum to move said tongue clamping element free end against the bias of said plate and away from said holding bar element when said tongue clamping element first end is pressed toward said plate adjacent to said first section cutout whereby a strap can be inserted between said tongue clamping element free end and said holding bar to be secured to said plate when said tongue clamping element first end is released to permit said tongue clamping element free end to move under the influence of the resiliency of said plate back toward said holding bar element.

2. A strap tensioning device according to claim 8 wherein the tongue clamping element has a base part which is integrally connected to the plate via sprung material bridging sections.

3. A strap tensioning device according to claim 2, wherein the holding bar element is located centrally of the plate,.

4. A strap tensioning device according to claim 1, wherein the holding bar element has a flap forming a broad clamping surface against the strap.

5. A strap tensioning device comprising:

a resilient monolithic plate which includes first, second and third sections, and a plurality of cutouts;

a tongue clamping element resiliently attached at a first end thereof to said plate and extending into a cutout in said first section and having a free end thereon;

a holding bar element attached at one end thereof to said plate and extending into another cutout and having a second end free;

a lever flap element attached at a base end thereof to said plate and extending into a cutout in said second section and having a free end;

said resilient monolithic plate being bent near the middle thereof to position said first section over said third section;

said holding bar element being bent to be adjacent to said tongue clamping element first end with the resiliency of said plate biasing said tongue clamping element first end toward said holding bar element;

said lever flap element being bent so said lever flap element free end contacts said tongue clamping element between said tongue clamping element first end and said tongue clamping element free end to form a fulcrum of a lever with said tongue clamping element rotating about said fulcrum to move said tongue clamping element first end against the bias of said plate and away from said holding bar element when said tongue clamping element free end is pressed toward said plate adjacent to said third section cutout whereby a strap can be inserted between said tongue clamping element first end and said holding bar to be secured to said plate when said tongue clamping element free end is released to permit said tongue clamping element first end to move under the influence of the resiliency of said plate back toward said holding bar element.

* * * * *